US006386994B1

(12) United States Patent
H'Doubler et al.

(10) Patent No.: US 6,386,994 B1
(45) Date of Patent: May 14, 2002

(54) GOLF GREEN BREAK READER

(76) Inventors: Peter B. H'Doubler, 1965 S. Fremont Ave.-Suite 2300, Springfield, MO (US) 65804; Alexander C. Wall, 988 Blvd. of the Arts #1617, Sarasota, FL (US) 34236

( * ) Notice: Subject to any disclaimer, the term of this patent is extended or adjusted under 35 U.S.C. 154(b) by 0 days.

(21) Appl. No.: 09/538,434

(22) Filed: Mar. 29, 2000

Related U.S. Application Data

(60) Provisional application No. 60/126,699, filed on Mar. 29, 1999.

(51) Int. Cl.[7] ..... A63B 57/00

(52) U.S. Cl. ..... 473/404; 33/379

(58) Field of Search ..... 473/404, 241, 473/406, 407, 285; 33/365, 377, 379; D21/793, 796

(56) References Cited

U.S. PATENT DOCUMENTS

| | | | | | |
|---|---|---|---|---|---|
| 669,068 | A | | 3/1901 | Arthur | 33/352 |
| 2,356,311 | A | | 8/1944 | Geier | 33/390 |
| 3,751,819 | A | * | 8/1973 | Dixon | 33/389 |
| D249,657 | S | | 9/1978 | Griffiths | D10/69 |
| 4,984,791 | A | | 1/1991 | Labell | |
| D318,243 | S | | 7/1991 | Piskula | D10/69 |
| 5,326,096 | A | | 7/1994 | H'Doubler | |
| 5,330,179 | A | | 7/1994 | Hampel | |
| D353,177 | S | | 12/1994 | Haughland | D21/221 |
| 5,403,001 | A | | 4/1995 | Skorpinski | |
| 5,411,253 | A | | 5/1995 | Kimble | |
| 5,431,391 | A | | 7/1995 | Tracey | |
| 5,476,258 | A | | 12/1995 | Frisone | |
| 5,492,322 | A | | 2/1996 | Smith | |
| 5,503,393 | A | | 4/1996 | Casperson | |
| 5,662,535 | A | | 9/1997 | Smith | 473/404 |
| 5,669,832 | A | | 9/1997 | Lehse | 473/404 |
| 5,707,299 | A | * | 1/1998 | McKenna | 473/241 |
| 5,792,015 | A | | 8/1998 | Hoyt | 473/404 |
| 5,865,689 | A | | 2/1999 | Heyman | 473/404 |
| 6,095,933 | A | * | 8/2000 | Smith | 473/404 |

* cited by examiner

*Primary Examiner*—Steven Wong
(74) *Attorney, Agent, or Firm*—Mark Douma

(57) ABSTRACT

An aid for the game of golf for assisting a golfer determine the slope or break of a golf green. The aid is placed on the green and the slope is read in two directions by sighting a level on top of the aid. Contact is made with the green by using contacts with preferred shapes. In particular, one preferred shape is a substantial segment of a golf ball complete with dimples. Additionally, in order to increase accuracy of the aid, its weight and the location of the green contacts are arranged so that each contact weighs on the green with the weight of a golf ball. Three green contacts are deemed preferable. A preferred level is a large area circular bubble level.

20 Claims, 8 Drawing Sheets

GOLF GREEN BREAK READER

CROSS REFERENCE TO RELATED APPLICATIONS

This application claims priority form a provisional application No. 60/126,699, filed on Mar. 29, 1999 and incorporated herein by reference.

BACKGROUND

1. Technical Field

This invention relates to a putting aid for the game of golf and, more particularly, to aid in determining the slope or break of a green. Patents related thereto may be found in U.S. class 473, subclass 404.

2. Background

Golf greens are not flat, but have various slopes to make the game more challenging. When a golf ball is putted, at first it tends to travel in a straight line, but as it approaches the cup and slows down, the direction of travel is determined more and more by the slope of the green. The challenge for the golfer is to visually determine the slope near the cup and attempt to make allowances for it by putting in a direction to compensate.

A number of putting aids have been devised. These cannot be used in regulation play, but are used as training aids. A typical example is U.S. Pat. No. 5,326,096, issued Jul. 5, 1994 to H'Doubler, one of the present inventors. This device comprises a generally flat housing having two grooves at right angles in which are located conventional linear float levels. The housing is placed on the green with one level pointing in the direction of the cup. Another example is U.S. Pat. No. 5,865,689, issued Feb. 2, 1999 to Heyman. In one embodiment, a hole is bored through a golf ball and a circular bubble level inserted in one end flush with the ball surface. A circular plate is adhered to the ball at the other end of the hole concentric with it. The plate forms a base that rests on the green.

These and other prior art devices appear to be workable to some extent. However, they may not produce truly accurate results. This is because a golf green is not a hard surface but a resilient grass mat. The usual Bermuda or Bent grass used at most golf courses is cut so that it has typically a 1/32nd to 1/16th inch (0.08 to 0.16 cm) stem with an approximately ½ inch (1.27 cm) blade. The blades tend to lie flat in a direction depending on raking direction. The dirt surface underneath is quite firm and uniform (to an estimated 1/32 of an inch), but the thickness of the overlaying grass mat has variable thickness and resiliency. In any event, the golf ball never touches the dirt. Prior art devices have not taken into account the existence of this resilient grass mat. Heavy devices would crush the mat and light devices would be influenced too much by a few blades of grass. None of the prior art devices make provisions for measuring the slope that would be encountered by a golf ball.

SUMMARY

Accordingly, the major object of the invention is to measure the slope of the green with a device that as closely as possible measures the slope that would be encountered by a golf ball. Other objects are to make a device that is easy to use without explanation. Of course, small size and economic mass production are always desirable.

These objects and others are realized in a golf green break reader having a level visible from the top of the reader and a base that makes contact with the green at two or more locations. The weight of the reader and the location of the contact are such that the weight at each contact approximates the weight of a golf ball. More preferably, the shape of the contacts simulates the shape of a segment of a golf ball and has a dimpled surface as does a golf ball. Thus, the break reader more accurately measures the slope of the green as would be seen by a golf ball.

One preferred version uses a relatively large circular bubble level of about three inches (7.62 cm) diameter and a base making three contacts to the green. The base is a single piece injection molded component with a generally triangularly shaped plate and three segments of simulated golf balls with dimples on the bottom. The level is fixed to the top with adhesive.

BRIEF DESCRIPTIONS OF THE DRAWINGS

The objects of the invention can be realized with a wide variety of mechanical structures, some of which are exemplified in the preferred embodiments illustrated in the drawings wherein.

DETAILED DESCRIPTION OF THE INVENTION

Figure 1:
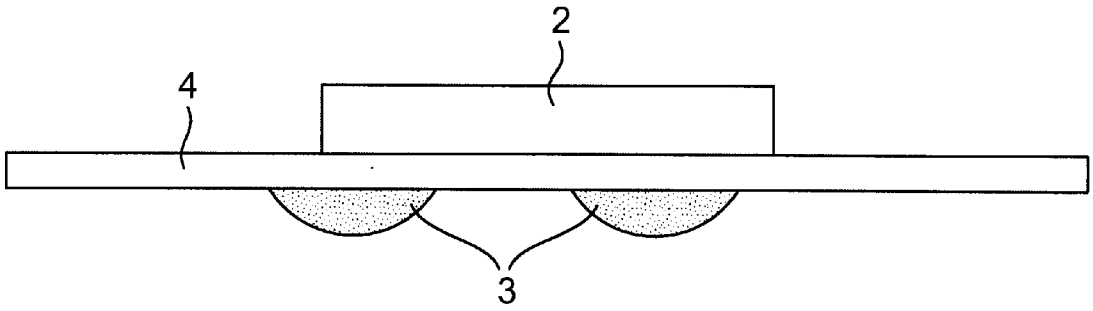
FIG. 1 is an elevation view of a first embodiment.
Figure 2:
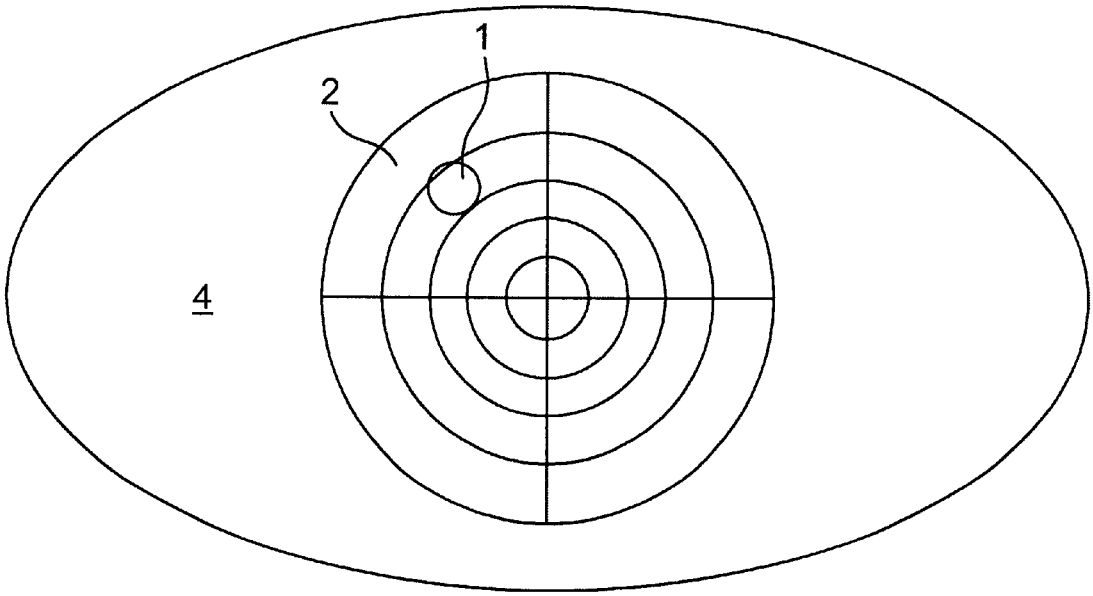
FIG. 2 is a top plan view of the embodiment illustrated in FIG. 1.
Figure 3:
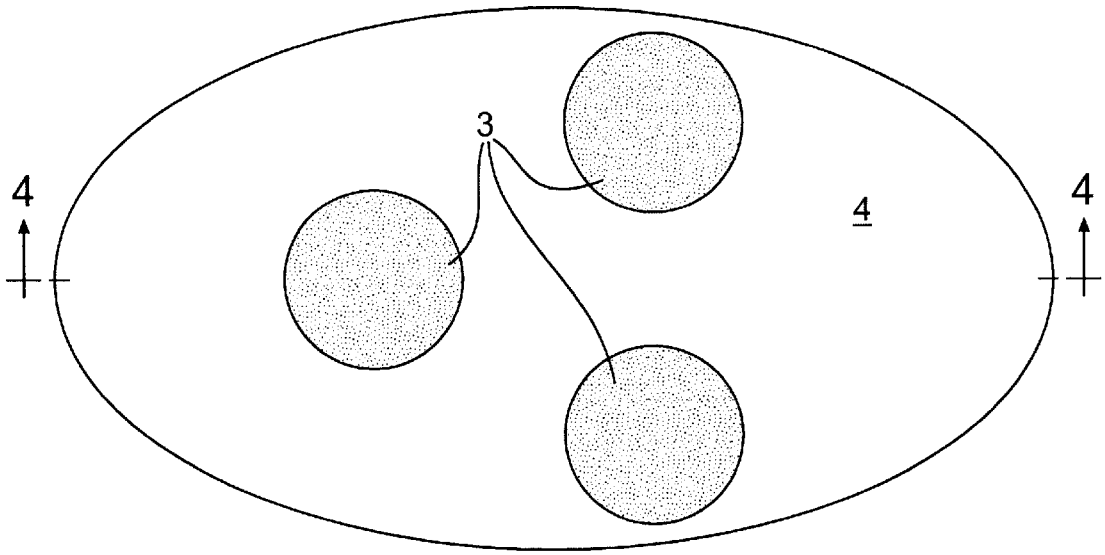
FIG. 3 is a bottom plan view of the embodiment illustrated in FIG. 1.

In the figures, like functions are designated with identical numbers. The words, top and bottom, are used in their customary sense to indicate a side or direction away from the green and toward it, respectively.

FIGS. 1 through 4 illustrate a first embodiment of the invention. The drawings are about ¾ scale, but the invention is not limited to any particular size. As illustrated, the device comprises a plate 4 on which is disposed a circular spirit level 2 having a bubble indicator 1. The three spherical segment green contacts 3 are disposed on the bottom of the plate 4. In use, the device is placed on a green and the direction and amount of slope is measured by the position of the bubble 1 with respect to the indicia seen through the liquid of the level 2.

Some prior art devices have used commercially available circular bubble levels similar to ones described in U.S. Pat. No. 2,365,311, issued Aug. 22, 1944 to Geier, and incorporated herein by reference. As will become apparent, these may not be preferable and a specially adapted design is described herein below.

In order to best achieve the major objective, it is preferable that the weight of the device be substantially equal to the weight of a number of golf balls equal to the number of green contacts 3, that is three in the figures. Also, the weight distribution should be such that there is substantially equal weight on each of the contacts 3. One method to achieve this is to use a circular shape for the plate for 4, place a circular level 2 in the center and locate the green contacts 3 equidistant from the center along 0°, 120°, and 240° axes. Another method is to use an equilateral triangle shape with the level in the center and the three green contacts located equidistant from the center along lines from the center to the apexes of the triangle.

For arbitrary shapes, it is necessary to find three points having equal moment arms from the center of gravity. This can be done by hand calculation, computer, or experimentally in a straightforward manner. The constant thickness oval shaped plate 4 illustrated in FIG. 4 simplifies the calculation. The plate 4 and level 2 combination has an axis of symmetry that goes through the center of gravity. Two of the green contacts are located equidistant from the axis of symmetry, but displaced along the axis away from the center of gravity. The third contact is centered on the axis on the other side of the center of gravity to produce a moment arm about the center of gravity equal and opposite to the sum of the moment arms of the other two balls.

Figure 4:
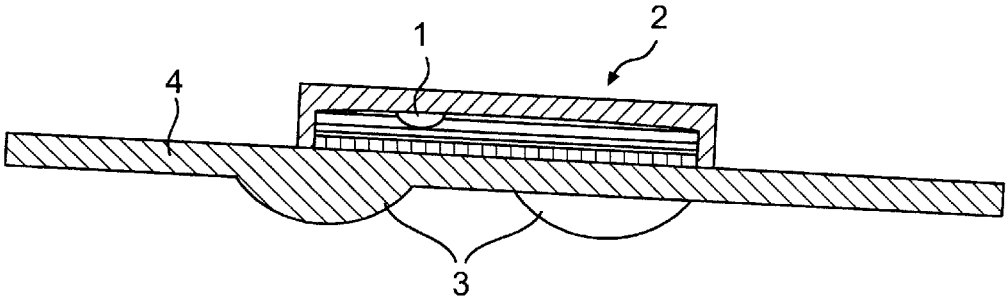
FIG. 4 is a cross-section of the the embodiment illustrated in FIG. 1 and shown with a 3° tilt from the horizontal.
Figure 5:
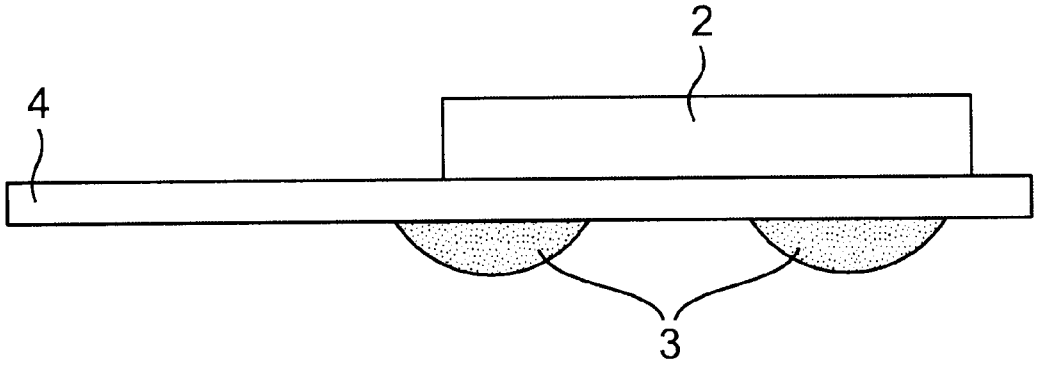
FIG. 5 is an elevation view of a second embodiment.
Figure 6:
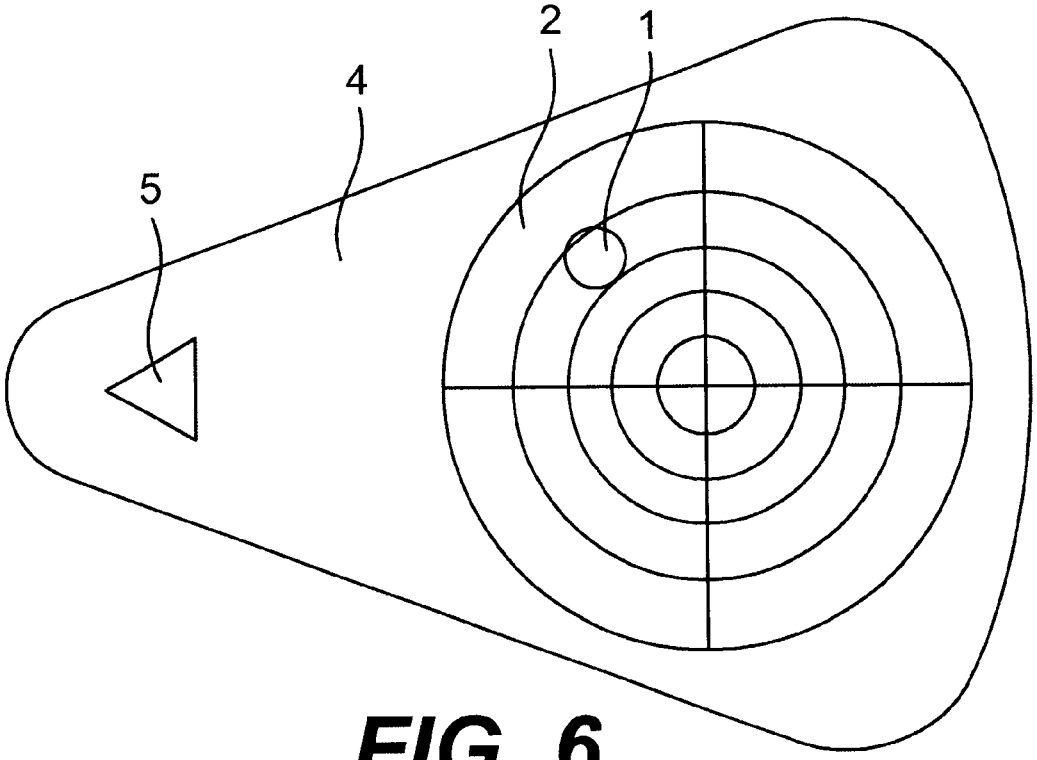
FIG. 6 is an elevation view of the embodiment illustrated in FIG. 5.
Figure 7:
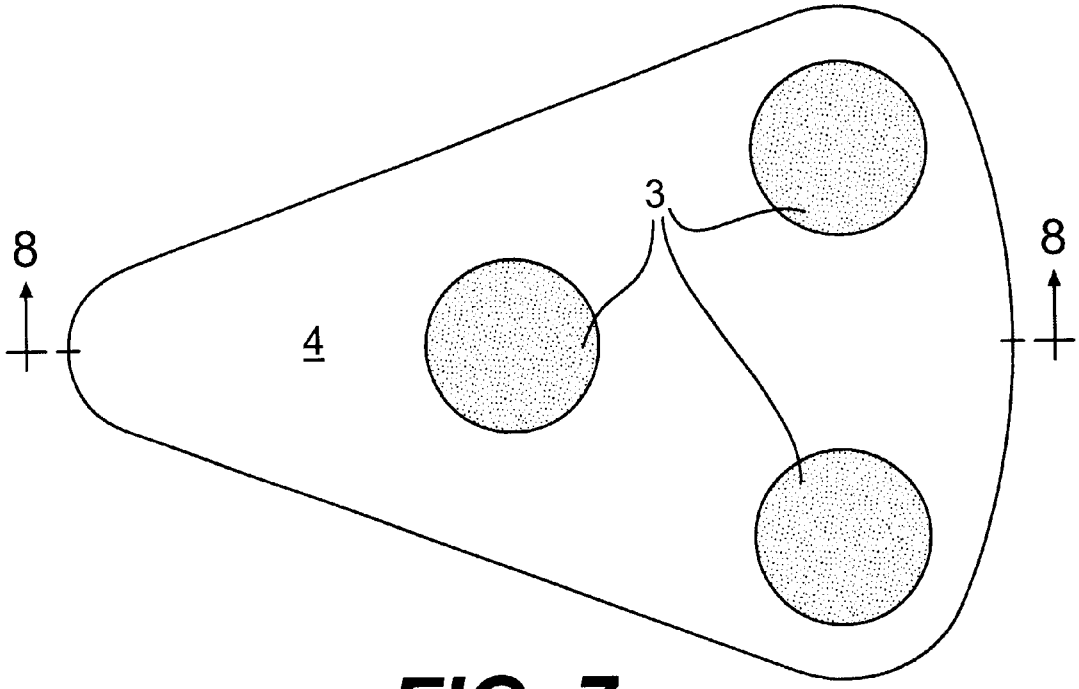
FIG. 7 is a bottom plan view of the embodiment illustrated in FIG. 5.
Figure 8:
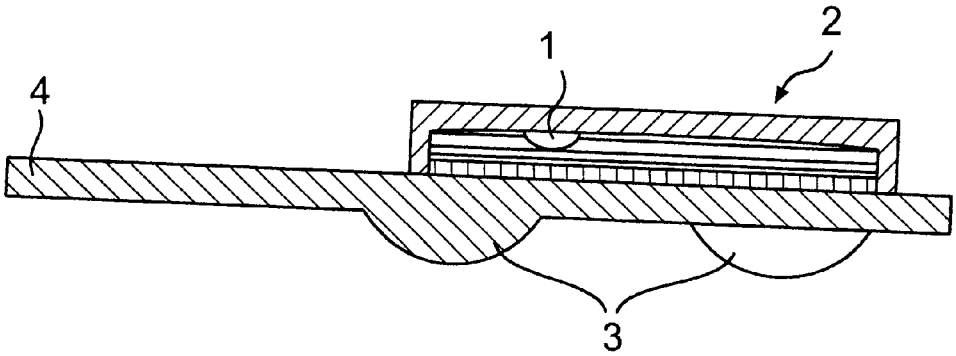
FIG. 8 is a cross-section of the embodiment illustrated illustrated in FIG. 5 and shown with a 3° tilt from the horizontal.

As illustrated in FIG. 4, the green contacts 3 are shown with crosshatching. This is meant to represent the dimples found on golf balls. While a smooth surface may work, the best simulation of a golf ball surface duplicates its dimples exactly. It is desirable that the green contacts should have the same radius as a golf ball (0.84 inches or 2.1 cm.). The height of the contacts depends on the thickness and resiliency of the grass mat. It was observed that the maximum distance a golf ball sinks into the mat is about 0.03 inches (0.08 cm). Therefore, the green contacts can be a small segment of a sphere. However, depending on the size of the plate, it may be necessary to use a larger segment, e.g., a hemisphere in order for the device to have the correct weight. Also, larger segments, approaching a hemisphere, make it obvious to a golfer how to use the device.

FIGS. 5 through 8, with similar designations for similar elements, illustrates a second preferred embodiment having better alignment properties. In use, the indicia 5 along with the isosceles triangular-like shape helps the golfer point one axis of the device toward the cup. The level 2 is located at the base of the isosceles triangle necessitating that the green contacts are located toward the base also.

While it is possible to make a separate plate 4, green contacts 3, and level 2 and assemble the device with adhesives, large scale production means that injection molded plastic is desirable. In that case, the plate 4 and the green contacts 3 would be one piece. Also, the commercially available levels referred to above are about one inch (2.54 cm) in diameter and thus may be difficult to view for a golfer standing up or even crouching. It is believed to be preferable that the level has a diameter of about three inches (7.62 cm). A method of making such a level will now be described.

Figure 9:
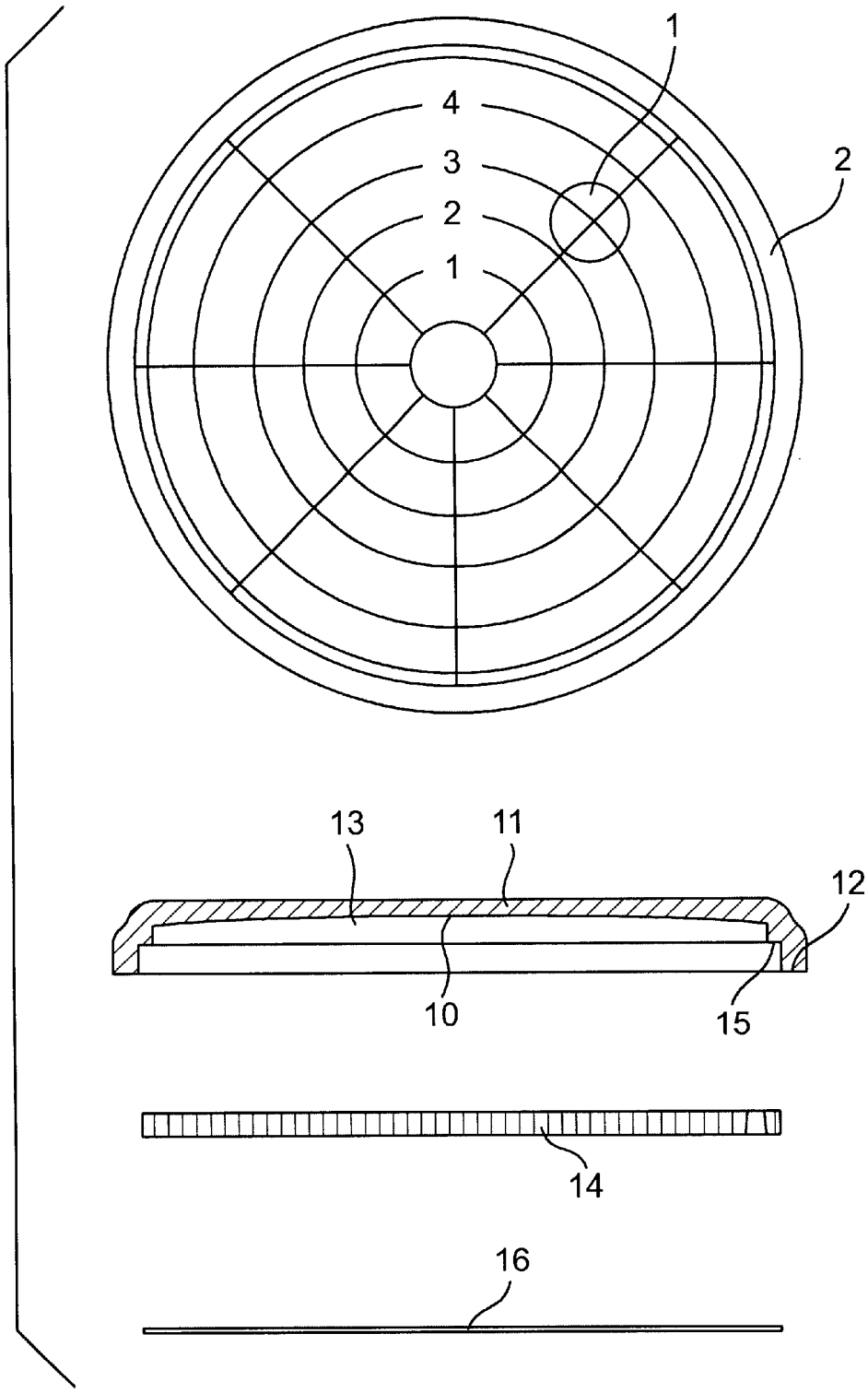
FIG. 9 is a cross-section and a plan view of a preferred level.
Figure 10:
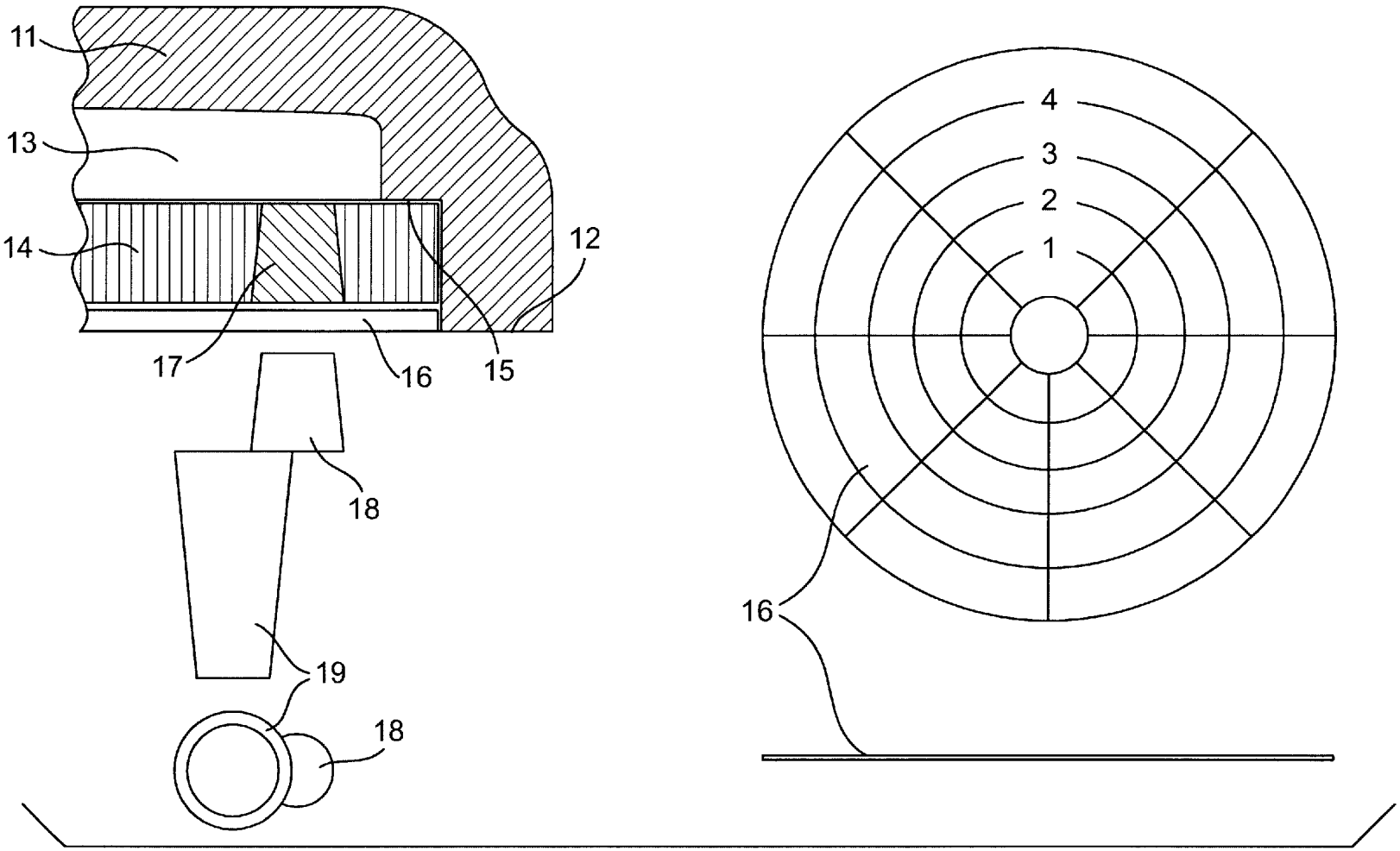
FIG. 10 shows details of FIG. 9 with an enlarged partial cross-section.

In this preferred embodiment, injection molding of plastic parts is used as the manufacturing method. FIG. 9 illustrates a preferred level at approximately ¾ scale while FIG. 10 shows an enlarged partial cross-section. The downwardly concave surface 10, usually but not necessarily a segment of a sphere, is formed on the inner surface of the top part of a shallow inverted cup 11. This surface can be made with very high accuracy since it is formed on a male element of the plastics mold, is very accessible to the mold making machine and the mold maker, and can be readily finished to optical quality. (Plastic eyeglass lenses are made by injection molding.) The accuracy of the mold is transferred faithfully to the molded part and hence the concave surfaces of the parts made in the mold will have uniform, identical accuracy.

The second element of accuracy is the relation between the top inner concave surface and the points of contact with the surface to be measured. The cup 11 has its downwardly extending sides terminating in a reference surface 12. This surface is formed by the same mold part that forms the concave surface, is integral with it, and has the same accuracy and quality as the concave surface. Thus, the accuracy of the relation between the concave surface 10 and the reference surface 12 is always faithfully maintained. As will be described, a closing member or back 14 is used to create a fluid cavity and slope indicating indicia 16 are adhered to the bottom of the back 14.

Closing the bottom of the cup 11 is necessary so that the cavity 13 thus formed may be filled with fluid to create a moveable bubble. It is important that the back 14 not protrude beyond the reference surface 12 or it will become a new less accurate reference surface. It is also important that the cavities formed when the backs are affixed to many levels, as they are made in production, be of uniform volume. If the cavities are of uniform volume, then, if an accurate quantity of fluid is injected, uniform bubble size will result. Available fluid dispensing machines can inject very accurate fluid quantities. This makes it possible to produce levels with uniform bubble size without human observation, thus greatly reducing cost. The production of uniform cavities 13 is achieved by forming on the inside surface of the downwardly extending sides of the cup 11 a supporting and sealing surface 15. The preferred embodiment of this sealing surface is a flat, narrow annular ring parallel to but recessed back from the reference surface 12. The back 14 is preferably a flat plate which, when it is in contact with the sealing surface 15, forms a cavity 13 of precise volume.

By using a thin liquid cement between the sealing surface 15 and the back 14 with sufficient pressure, the displacement of the back away from the sealing surface can be held to less than 0.0001 inches (0.00025 cm). A very effective combination is achieved by using Loctite Corporations's (Rocky Hill, Conn.) ultra violet (UV) light curable cement #3105 and long wavelength UV exposure of about 10 seconds that will produce a bond that approaches the strength of the styrene or acrylic preferred molding materials. Since the cup 11 and back 14 are of the same material and, moreover, have substantially uniform cross sections, temperature distortions that affect accuracy are substantially reduced.

Filling is accomplished by holding the central plane of the level at about 15 degrees from the vertical and rotated so that the filling hole 17 is at the top. It is important that the filling hole be close to one edge of the cavity so that the bubble encompasses the hole. Preferably, filling is accomplished with a precision injector that dispenses a precise amount of fluid so that, since the cavity is accurate, the bubble will have a precise predetermined size. When used as a level, the preferred bubble size is one which will not contact the bottom inner surface of the back 14. Not only does this make the back design simpler and less costly, but it means that only the accuracy of the top inner surface has an effect.

Sealing the filling hole after filling requires a plug 18 that does not protrude below the reference surface. This can be conveniently accomplished by using plugs of the same material and made at the same time as the cup and back. As shown, these are made in the form of a 5 degree tapered plug with an extension 19 that is used as a handle. The plug is glued into the hole and then the handle 19 is broken off and discarded.

For the level to be useful, index lines must be affixed. Printing on the plastic parts is difficult and expensive. A preferred method of forming the slope indicating indicia 16 is to print the index lines and data on moisture resistant die cut heavy paper stock that fits inside the recess formed between the back 14 and the sides of the cup 11. The thickness of the paper stock is made less than the distance from the underside of the back 14 to the reference surface 12 so as not to interfere with the accuracy of the level. The index circles and direction lines can be read through the filling fluid with the position of the bubble plainly visible.

The speed of response of the level and sensitivity to extraneous movement depends on the viscosity of the filling liquid. A satisfactory solution for the filling liquid is to use a clear mineral oil produced by Witco Chemical Company (Greenwich, Conn.) called PD23. It has a viscosity of about 2.9 centistokes. Bubble action is quite fast but still damped so as not to be erratic. Dying the oil to improve bubble visibility is usually desirable. BASF Chemical Company (Mt. Olive, N.J.) dye #084 yellow is satisfactory at a concentration of about 0.01%. It is slightly fluorescent making the bubble quite visible in sunlight or under artificial lighting.

There are a large number of plastic molding compounds that can be used. The least expensive molding material is styrene. Novacor (a trademark of Dow Chemical Company, Midland, Mich.) #555-227 clear styrene has moderate strength, resists scratching, cements very satisfactorily, and molds well with consistent results. It is crystal clear in the visible and has good long wave UV transmissibility that facilitates using fast curing UV cements. Acrylic (Rohm and Hass trademark, Plexiglass) is more durable and equally satisfactory in other respects but is about 50% more expensive.

Levels, standing alone from the plate 4, made with the preferred method were found to have final perceived accuracies of about one arc minute that is equivalent to a slope of about 0.003 inches per foot.

Next the level should be attached to the plate 4. This can be accomplished with the adhesive used to construct the level. Of course, a jig should be used to position the level on the plate. Since the plate 4 and green contacts 3 are made as a single piece injection molding, accuracy of the level in reading green slopes should be maintained.

A less accurate prototype device was constructed by cutting three golf ball segments and adhering them to a plate cut out from a polystyrene sheet. A level such as the one just described was adhered to the top surface. An experiment was undertaken in which the device was placed on a green in front of experienced golfers. Almost invariably, the golfers knew what the device was and how to use it.

Figure 11:
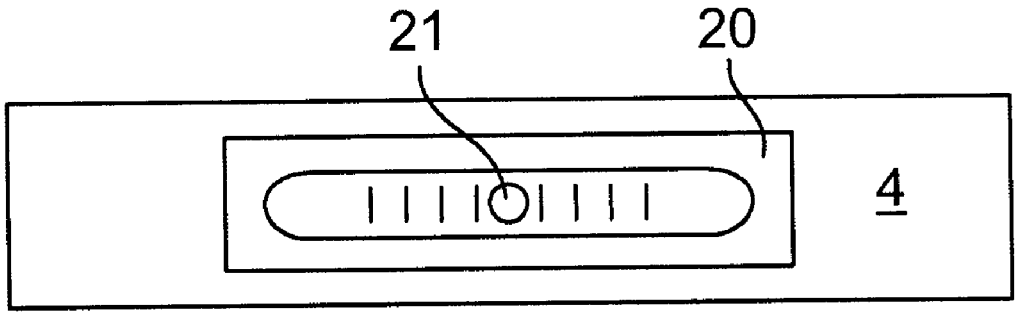
FIG. 11 is a top plan view of a one-dimensional embodiment.
Figure 12:
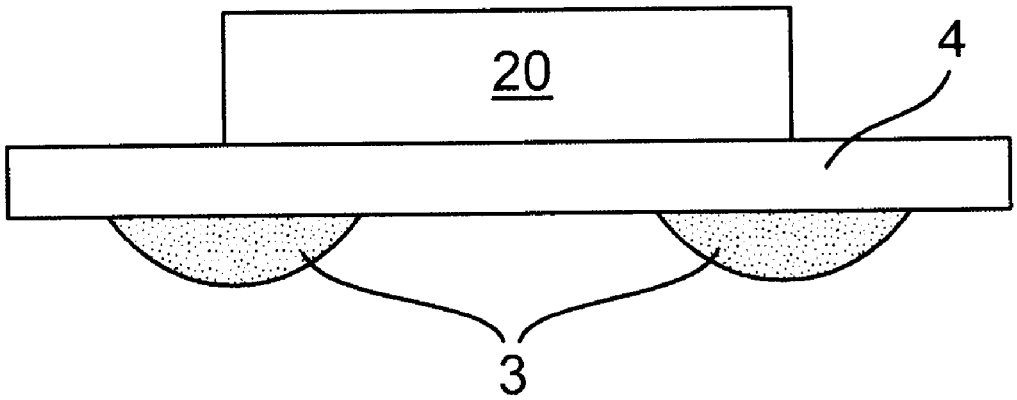
FIG. 12 is an elevation view of the embodiment in FIG. 11.

Having described the preferred embodiments, several variations can be mentioned. For example, the number of green contacts 3 need not be limited to three. If only two are used, the device could still measure the slope along one direction This is illustrated by FIGS. 11 and 12 that show a conventional one-dimensional spirit level 20 with bubble 21. However, it would be unstable unless supported by band, friction, or a third green contact of some sort. Since three points determine the orientation of a plane, if more than three are used and the green at the place being measured is not planar, the green contacts over the three highest points of the green will determine the slope. Nonetheless, the possibility of using, e.g., two green contacts, a ring of green contacts or some other variation is not excluded from the scope of the invention.

The green contacts 3 are preferably a simulation of a golf ball with dimples. However, leaving off the dimples may work and would save on mold tooling costs. It may be possible that a different radius of curvature or a non-spherical shape would simulate a golf ball with dimples. This will be a function of the compliance of the grass mat and friction of the grass against the contact surface. Another variation is to use a cylindrical post with a small segment of golf ball at the bottom. Still another variation is to use a cylindrical post with a flat green contact. By adjusting the diameter of the post, it might be possible to equal the effect of a golf ball. Still another variation, would be to use a rubber or other contact surface. However, all of these variations would be grass mat dependant. Thus, experimentation, albeit routine, would be required to determine the structural parameters that would best simulate a golf ball.

The plate 4 that supports the level has been described as flat. This is because injection molds having at least one flat surface are less expensive. However, the function of the plate is to extend the level reference surface to the green contacts. This could be accomplished with a variety of shapes. As an example, the plate could have holes in it, be non-planar, be in the shape of a tripod, etc. Of course, for best results, the weight of the assembly should approximate the weight of a number of golf balls equal to the number of green contacts. Normally, the level 2 will be arranged so that the bubble 1 is at top dead center when the plane of the green contacts 3 are level.

Figure 13:
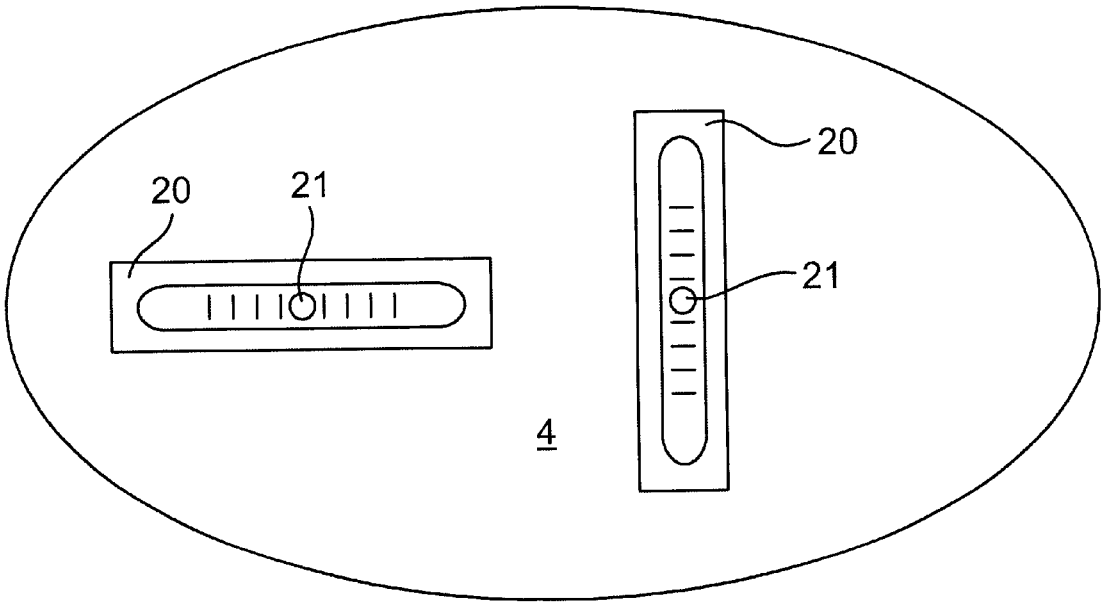
FIG. 13 is a view of the embodiment of FIG. 2 with two orthogonal one dimensional levels.
Figure 14:
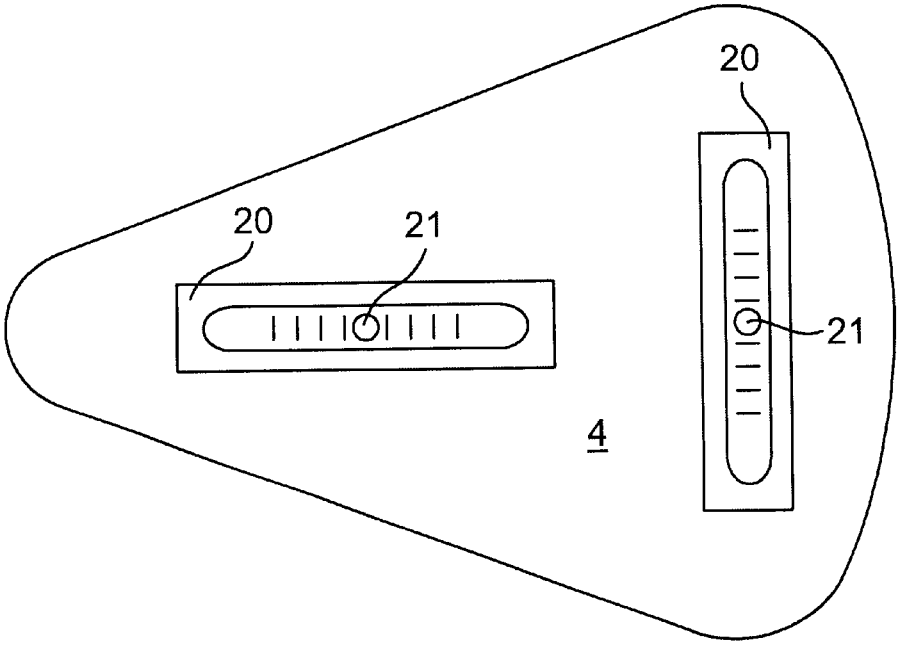
FIG. 14 is a view of the embodiment of FIG. 6 with two orthogonal one-dimensional levels.

While the usual embodiment of the level 2 is circular, this is by no means necessary. It might be desirable to make the level 2 in a rectangular, triangular, oval, or other shape. Furthermore, while it is usual for the top inner concave surface 10 to be a segment of a sphere, this again is by no means necessary. If the surface were, for example, of elliptical shape, then the action of the bubble would be non-linear. It would be more sensitive at the center and less sensitive as it moved away from the center. This would produce a level having a much wider range of slope. Also the concave surfaces, whether of spherical or other shape, are usually surfaces of revolution. Yet again this is not necessary. The surfaces can be of special shape to produce bubble motion having characteristics which express special desired motions. With the current ability to generate computer controlled surfaces through numerically controlled machines, the concave surface together with the proper relation of the support surface and the sealing surface could be of any desired shape while retaining the accuracy of the conventional circular design. Another alternative would be to substitute two substantially orthogonal one-dimensional spirit levels as used by one of the present inventors in his U.S. Pat. No. 5,326,096 cited above. FIGS. 13 and 14 illustrate such a substitution of conventional spirit levels 20 with bubbles 21 in the embodiments of FIGS. 2 and 6, respectively.

Use of the invention is not limited to golfers. Greens keepers may also find it useful. For this use, the indicia 16 would be arranged to provide a calibrated slope indication.

Having described the preferred embodiments, obvious variations and equivalents will occur to others skilled in the art. The invention is not limited to the preferred embodiments given by way of example, but only by the claims.

What is claimed is:

1. A golf green break reader comprising:

a slope indicator;

at least two green contacts; and connecting structure making a mechanical connection between said slope indicator and said green contacts, wherein the combined weight of said slope indicator, green contacts, and connecting structure is selected so that in conjunction with the shape and resiliency of said green contacts, said contacts simulate a golf ball placed on the green.

2. The break reader of claim 1 wherein said green contacts are three in number.

3. The break reader of claim 1 wherein said green contacts are a plurality arranged in a ring.

4. The break reader of claim 1 wherein the portion of said green contacts making contact to the green is a segment of a sphere.

5. The break reader of claim 4 wherein said spherical segment has dimples whereby a golf ball surface is simulated.

6. The break reader of claim 1 wherein said green contacts are posts protruding from the bottom of said connecting structure.

7. The break reader of claim 6 herein the portion of said posts making contact to the green is a segment of a sphere.

8. The break reader of claim 7 wherein said spherical segment has dimples whereby a golf ball surface is simulated.

9. The break reader of claim 1 wherein said greens contacts are three in number and said connecting structure is in the form of a tripod.

10. The break reader of claim 1 wherein said slope indicator comprises at least one one-dimensional spirit level.

11. The break reader of claim 1 wherein said slope indicator comprises a first one dimensional spirit level and a second one-dimensional spirit level substantially orthogonal to said first level.

12. The break reader of claim 1 wherein said slope indicator comprises a two-dimensional spirit level.

13. The break reader of claim 12 wherein said two-dimensional spirit level has a substantially circular shape.

14. A golf green break reader comprising:

a plate having a triangular shape;

a spirit level disposed on the top of said plate;

three hemispherical green contacts disposed on the bottom of said plate and arranged at positions so that the weight of said plate, level and green contacts is distributed approximately equally and wherein the total weight of said break reader is approximately the weight of three golf balls.

15. The break reader of claim 14 wherein said green contacts have dimples that simulate those of a golf ball.

16. The break reader of claim 14 wherein said spirit level is circular and has visible indica disposed on its underside whereby the slope of the green may be quantitatively measured.

17. The break reader of claim 14 wherein said triangular shape is isosceles with rounded vertices and further having a directional arrow at its apex.

18. The break reader of claim 14 wherein said green contacts have dimples that simulate those of a golf ball and said spirit level is circular and has visible indica disposed on its underside whereby the slope of the green may be quantitatively measured.

19. The break reader of claim 18 wherein said triangular shape is isosceles with rounded vertices and further having a directional arrow at its apex.

20. A golf green break reader comprising:

means for indicating a slope;

means for contacting a golf green in three places and simulating the shape of a golf ball; and means for making a mechanical connection between said slope indicating means and said green contacting means wherein the weight of said slope indication means, said green contacting means, and said mechanical connection means is approximately the weight of three golf balls.

* * * * *